US006535130B2

(12) United States Patent
Nguyen et al.

(10) Patent No.: US 6,535,130 B2
(45) Date of Patent: Mar. 18, 2003

(54) SECURITY APPARATUS FOR ELECTRONIC ARTICLE SURVEILLANCE TAG

(75) Inventors: Thang Nguyen, Boca Raton, FL (US); David B. Ferguson, Boca Raton, FL (US); Roy Hannes, Sunrise, FL (US); Dennis L. Hogan, Lighthouse Point, FL (US); Michael A. Peluso, Fort Lauderdale, FL (US); Sergio Perez, Boynton Beach, FL (US); Manuel A. Soto, Lake Worth, FL (US); Craig Szklany, Lighthouse Point, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/843,314

(22) Filed: Apr. 25, 2001

(65) Prior Publication Data

US 2002/0158762 A1 Oct. 31, 2002

(51) Int. Cl.[7] ..... G08B 13/14
(52) U.S. Cl. ..... 340/572.9; 340/571; 340/572.8
(58) Field of Search ..... 340/571, 572.1, 340/572.3, 572.8, 572.9; 70/57.1, 271; 24/704.1

(56) References Cited

U.S. PATENT DOCUMENTS

| | | | | |
|---|---|---|---|---|
| 4,356,477 A | | 10/1982 | Vandebult | 340/572 |
| 4,429,302 A | | 1/1984 | Vandebult | 340/572 |
| 4,510,489 A | | 4/1985 | Anderson et al. | 340/572 |
| 4,510,490 A | | 4/1985 | Anderson et al. | 340/572 |
| 4,573,042 A | | 2/1986 | Boyd et al. | 340/539 |
| 4,686,513 A | | 8/1987 | Farrar et al. | 340/572 |
| 4,686,516 A | | 8/1987 | Humphrey | 340/572 |
| 4,797,658 A | | 1/1989 | Humphrey | 340/551 |
| 5,367,289 A | | 11/1994 | Baro et al. | 340/566 |
| 5,426,419 A | | 6/1995 | Nguyen et al. | 340/572 |
| 5,528,914 A | * | 6/1996 | Nguyen et al. | 70/57.1 |
| 5,535,606 A | * | 7/1996 | Nguyen et al. | 70/57.1 |
| 5,570,080 A | * | 10/1996 | Inoue et al. | 340/571 |
| 5,589,819 A | | 12/1996 | Takeda | 340/571 |
| 5,955,951 A | * | 9/1999 | Wischerop et al. | 340/572.8 |
| 6,373,390 B1 | * | 4/2002 | Hogan et al. | 340/572.8 |

FOREIGN PATENT DOCUMENTS

WO WO 00/52656 9/2000

* cited by examiner

*Primary Examiner*—Benjamin C. Lee
*Assistant Examiner*—Phung T Nguyen
(74) *Attorney, Agent, or Firm*—Rick F. Comoglio

(57) ABSTRACT

An EAS tag in which the tag is held to an article by an attaching assembly a part of which is releasably prevented from being withdrawn from the body of the tag. The tag body is provided with an arcuate channel through which an arcuate detacher probe can be guided for releasing the attaching assembly part. A spring clamp provides the releasable preventing function and includes jaws specifically adapted to respond to in-plane torsional forces provided by the arcuate probe which is moved through the arcuate channel by rotation to reach the spring clamp. The tag has improved anti-defeat devices and methods including one or more of the following; a shield to protect the EAS sensor, a shield to protect the releasable spring clamp, a tag self-alarm that alarms upon various unauthorized defeat attempts, an LED to signal an armed condition of the tag alarm, a magnet switch to alarm the tag upon exposure to a relatively strong magnetic field, and a plurality of apertures to decoy the position of the alarm piezo.

20 Claims, 17 Drawing Sheets

SECURITY APPARATUS FOR ELECTRONIC ARTICLE SURVEILLANCE TAG

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance (EAS) tags, and more particularly, to an EAS tag with improved anti-defeat mechanisms.

2. Description of the Related Art

Electronic article surveillance systems are well known in the art and are used for inventory control and to prevent theft and similar unauthorized removal of articles from a controlled area. Typically, in such systems a system transmitter and a system receiver are used to establish a surveillance zone, which must be traversed by any articles being removed from the controlled area. An EAS tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

Certain types of EAS tags are deactivatable, are disposable, and may be permanently affixed to articles. Other types of EAS tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism.

U.S. Pat. No. 5,426,419, entitled Security Tag Having Arcuate Channel and Detacher Apparatus for Same, (the '419 patent) the disclosure of which is incorporated herein by reference, discloses an EAS tag that has a relatively hard tag body, which is adapted to be releasable from an article in an easy and simple manner by insertion of the arcuate probe of an associated detacher device into an arcuate channel of the tag to release a spring clamp mechanism. The spring clamp mechanism is a releasable locking mechanism that prevents removal of a tack assembly that is adapted for insertion through an article, which is captured when inserted into an opening in a portion of the tag body.

FIGS. 1–7 show various views of an EAS tag 1 in accordance with the principles of the invention disclosed in the '419 patent, a portion of the description of which follows herein. As shown in FIG. 1, the tag 1 includes an upper housing 2 having side walls 2A, 2B, 2C and 2D which are joined by a top wall 2E. The tag 1 also includes a lower housing 3 having side walls 3A, 3B, 3C and 3D which are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A.

The housings 2 and 3 are preferably made of a hard or rigid material. A usable rigid or hard material might be a hard plastic such as, for example, an injection molded ABS plastic. If a plastic is used, the mating side walls of the housings can be joined by an ultrasonic weld 1B or like joining mechanism.

The tag 1 further includes a tack assembly 4 shown as having an enlarged tack head 4A and an elongated tack body 4B provided with slots or grooves 4C and a pointed forward end 4D (see, FIGS. 1, 2 and 6A). The tack assembly 4 is used to attach the tag body 1A to an article 51, which is to be protected by the EAS tag 1.

In order to sense the tag 1 and, therefore, detect the presence of the tag and the attached article 51, the inner surfaces 2F and 3F of the walls 2E and 3E of the housings 2 and 3 are provided with frame members 2G and 3G which together define an interior cavity 1C for receiving an EAS sensor 5 (see, FIGS. 2, 3 and 4A). The EAS sensor 5 can be any sensor that generates detectable EAS signals, and may be an acoustically or mechanically resonant magnetic sensor such as, but not limited to, that disclosed in U.S. Pat. Nos. 4,510,489 and 4,510,490. Possible other magnetic EAS sensors usable for the sensor 5 might be, but not limited to, those disclosed in U.S. Pat. Nos. 4,686,516 and 4,797,658 and possible RF EAS sensors might be, but not limited to, those disclosed in U.S. Pat. Nos. 4,429,302 and 4,356,477.

As above-noted, the article 51 is joined to the tag body 1A by the tack assembly 4. This is accomplished by inserting the tack body 4B into an opening 2H in the wall 2E of the upper housing 2. When the tack body 4B is fully inserted, the pointed end 4D of the tack is received in an upstanding cavity or collar 3H extending from the inner surface 3F of the lower housing wall 3E. The tack head 4A, in turn, seats in a recessed area 21 in the upper surface 2J of the wall 2E. The article 51 is thus held between the tack head 4A and the latter wall.

Member 6 to be discussed in greater detail below is provided within the tag body 1A for releasably preventing the tack body from being withdrawn from the tag body. The tack assembly 4B and the article 51 thus become releasably locked to the EAS tag by the member 6.

The EAS tag 1 is further adapted so that access to the member 6 for releasing same is made difficult for other than authorized personnel. To this end, the tag body 1A is configured so that access to the member 6 is through an arcuate channel 7 (see FIGS. 1, 3, 4A, 4B, 6A and 6B) defined by one or more inner walls and by parts of the side walls and upper and lower walls of the tag body 1A. With this configuration, a special arcuate probe 8 is needed to reach and release the member 6 and, thus, detach the tack assembly 4 and the article from the tag body 1A.

As shown, the arcuate channel 7 is defined by a curved inner wall 7A. This wall extends upward from the inner surface 3F of the bottom housing 3 to abut the inner surface 2F of the upper housing 2. The wall 7A is further spaced from the side wall 3D of the bottom housing 3 and its outward end 7A' terminates at an inward curved part 3A' of the side wall 3A. The inward curved part 3A' of the wall 3A results in a space or slot 9A between the side walls 3A and 3D of the lower housing 3.

The slot 9A cooperates with a similar slot 9B between the sides wall 2A and 2D of the upper housing 2 to define a second opening 9 for providing entry or access into the outward end 7' of the channel 7. At this entry point, the side wall 2A also curves inwardly at a part 2A', the latter part 2A' mating with the curved side wall part 3A' of the side wall 3 of the lower housing 3.

The channel 7 is further defined by a second curved wall 7B (see, FIGS. 4A and 7) extending downwardly from the inner surface 2F of the upper housing 2. The wall 7B is situated outward of the inner end 7A" of the curved wall 7A and extends beyond this end to the frame member 2G.

The presence of the wall 7B changes or alters the configuration of the channel 7 at its inner end 7" which end lies adjacent the member 6 (see, FIG. 6B). This change or alteration in configuration defines a keyway for the channel 7 which must be accommodated by the probe 8 to pass through the channel and gain access to the member 6.

The wall 7B changes the channel cross section from substantially rectangular to substantially L-shaped. This is illustrated in the cross section of FIG. 7 which has been taken along the line B—B in FIG. 1 so that the cross section of the channel end 7" is made visible.

FIGS. 6A and 6B are enlarged views of the section of the lower housing 3 containing the member 6 and the arcuate channel 7. In FIG. 6A, the arcuate probe 8 is shown as received in and guided by the channel 7 to the member 6 for the purpose of releasing same. As can be seen, the forward end 8A of probe 8 is L-shaped and, thus, fit within the L-shaped keyway defined by inner end 7" of the channel. In FIG. 6B, the probe 8 is shown as withdrawn from the channel.

Adjacent the inner end 7" of the channel 7, the lower and upper housings 2 and 3 are provided with further curved walls 9 and 11 which terminate in wall sections 9A and 11A abutting the end walls 2D and 3D. The walls 9 and 11 are outward of the channel 7 and, with the end walls 2D and 3D, define a trap area 13, which prevents access to the member 6. This area provides a safety measure for blocking unauthorized objects introduced into the channel 7 of the tag body 1A in an attempt reach the member 6.

As above-noted, the member 6 is adapted to releasably prevent the tack body 4B from being withdrawn from the tag body 1A. More particularly, the member 6 is specifically adapted to accommodate release of the tack body 4B via the arcuate probe 8 moving in the arcuate channel 7. The member 6 is shown in detail in FIGS. 6A and 6B and in an exploded view in FIG. 5.

As shown, the member 6 is in the form of a spring clamp having a clamp body 14 and jaws 15 and 16. The clamp body includes a mounting part 1 4A extending laterally of the jaw 15 and a release part 144B extending laterally of the jaw 16. The mounting part 14A includes a mounting aperture 14A'.

Each of the jaws 15, 16 extends outwardly of the plane of the clamp body 14 and then inwardly toward the other jaw. The jaws 15, 16, furthermore, terminate in facing edges 15A and 16A. These edges extend from a common edge 14C of the clamp body 14 inwardly toward each other, then curve outwardly away from each other to define an aperture 14C' (typically, circular or elliptical) for receiving the tack body 4B. The edges 15A and 16A then continue in aligned fashion and end in an elongated, lateral slot 14D in the clamp body 14. The latter slot lies inward of a further clamp body edge 14E, which opposes the clamp body edge 14C.

A further laterally extending elongated spring sleeve or arm 17 is attached by a joint area 18 to the side 14E' of the edge 14E bordering the mounting part 14A. The sleeve 17 extends along the length of the edge 14E and is also out of the plane of the clamp body.

For mounting and supporting the spring clamp 14, the lower housing 3 of the tag body 1A includes a hollow circular mount 21 with a lip 21A and support walls 22, 23 and 24 (see, FIGS. 2, 3, 6A and 6B). The clamp is mounted, via the aperture 14A' of the mounting part 14, on the mount 21 with the area of mounting part adjoining the aperture 14A' supported on the lip 21A. A circular wall 25 of the upper housing 3 and a central cylindrical stud 26 of this housing (see, FIGS. 2 and 4A) maintain the mounting part 14A in its mounted position, while allowing the mounting part to be rotated. The spring clamp 14 is thus able to pivot about the mounting part as will be described more fully below.

The back end 14A" of the mounting part 14A and the lateral part of the clamp connecting the mounting part 14A and the release part 14B are supported on the support walls 22 and 24, while the release part is carried by the wall 23. The spring sleeve 17 rests with one end 17A in a slot 24A in the support wall 24.

When the pointed end 4D of the tack body 4B is introduced in the downward direction through the opening 2H in the upper housing 2, the part 2K of the upper housing, which part is shaped to fit within the hollow of the spring clamp body 14 above the jaws 15, 16 and carries the opening 2H, directs the tack body to the aperture 14C' defined by the facing edges 15A, 16A of the jaws. This causes the jaws to spread or open and allow the tack body 4B to pass through the jaws.

When the downward tack travel is stopped at a desired slot 4C, i.e., a slot which provides a tight fit of the tack head 4A and article 51 to the wall 2E of upper housing 2, the jaws 15, 16 retract and clutch the tack body 4B. In this position, the jaws 15, 16 prevent upward movement of the tack 4. The tack 4 and article 51 thus become locked to the tag body 1A.

In order to release the tack 4 from the tag body 1A, the arcuate probe 8 is now introduced into the opening of the tag body 1A via rotation of the probe about its rearward end 8B. This causes the probe to be moved in and guided by the channel 7 until the L-shaped forward end 8A of the probe reaches and passes into the L-shaped inner end 7" of the channel 7. This brings the probe end 8A to the part of the common edge 14C bordering the release part 14B of the clamp body 14.

Continued rotational movement of the probe 8 then causes a force on the release part 14B. This force, in turn, causes the clamp body 14 to rotate about the support area 14A on the mount 21. The jaws 15, 16 are thus enabled to spread apart or open due to the force of the tack body 4B, which is held stationary by the collar 3H, acting on the walls of the aperture 14C'. The aperture 14C' thus expands, releasing the tack body 4B from the grip or clutch of the jaws. The tack 4 can now be moved in the upward direction past the jaws, via an upward force on the tack head 4A, thereby withdrawing and separating the tack body 4B from the tag body 1A and the article 51 from the tag 1.

During rotation of the spring clamp body 14 as a result of the in-plane force exerted by the probe 8, the spring arm 17 at the joint 18 is compressed. After the tack 4 is separated from the tag body 1A, the probe 8 is rotated in the reverse direction. This reverse rotation disengages the probe from the release part 14A of the spring clamp 14 as the probe 8 is withdrawn from the channel 7. The force on the spring clamp 14 is thus removed and the spring arm 17 expands. This causes the spring clamp 14 to rotate in the opposite direction about the support area 14A. The spring clamp 14 is thereby brought back to its original position awaiting reentry of the tack body 4B for again attaching an article to the tag 1.

Detaching assemblies which incorporate the arcuate detaching probe 8, and can be used to rotate the probe as above-described to detach the tack 4 from the tag 1 are fully illustrated in the '419 patent, which has been incorporated herein by reference. It should be noted that the spring clamp 14 of the tag 1 can be constructed of spring sheet metal. The probe 8, in turn, can be constructed of hardened tool steel.

The EAS tag of the '419 patent is difficult to defeat, but attempts are constantly made to defeat the tags by damaging the tags or by unauthorized removal of the tags from the article to which they are attached to prevent detection of the articles as they pass through the surveillance zones. Once an EAS tag is put into service, attempts at unauthorized removal begin. After a period of time, defeating techniques may become known to persons wanting to remove articles undetected by associated EAS systems. Modifications and improvements to the EAS tag become a natural progression in an attempt to stay ahead of the known defeat techniques. U.S. patent application Ser. No. 09/634,236, filed on Aug. 8, 2000, the disclosure of which is incorporated herein by reference, illustrates certain improvements to the EAS tag disclosed in the '419 patent to make defeating the tag more difficult. Further improvements to prevent unauthorized tag defeats are disclosed hereinbelow.

BRIEF SUMMARY OF THE INVENTION

In accordance with a first aspect of the present invention, an electronic article surveillance tag is provided in which the tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. A shield is provided in said tag body adjacent the sensor to prevent insertion of an instrument through the tag body and into the sensor to damage the sensor.

The preventing mechanism can include a receiving and clutching mechanism, which receives and clutches the tack body, thereby preventing withdrawal of the tack body from the tag body. A release part of the receiving and clutching mechanism when engaged causes the receiving and clutching mechanism to release, thereby allowing withdrawal of the tack body. A second opening in the tag body leads to the arcuate channel which, in turn, leads to the release part of the receiving and clutching mechanism to allow the arcuate probe to engage same to effect the release. A shield is disposed in the tag body adjacent the releasing and clutching mechanism to prevent unauthorized release of the receiving and clutching mechanism by other than the arcuate probe.

The above described shield in said tag body adjacent the sensor to prevent insertion of an instrument through the tag body and into the sensor to damage the sensor can be included in the tag body with the shield used to prevent unauthorized release of the tack assembly.

In a second aspect of the present invention, an electronic article surveillance tag is provided in which the tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. An alarm is disposed within the tag body, for sounding an audible alarm if the tack assembly is withdrawn from the tag body without the arcuate probe being guided through the arcuate channel to the preventing mechanism.

An LED or other light-emitting device can be made visible on the exterior of the tag body to periodically flash when the alarm is armed.

A plurality of relatively small apertures can be disposed on the tag body to permit the audible sound from the alarm to travel from the interior of the tag body to the exterior of the tag body. The plurality of apertures covers a sufficient portion of the tag body to prevent external localization of the position within the tag body of a sound emitting mechanism for generating the sound from the alarm.

A magnet switch for triggering the alarm when a relatively strong magnetic field is incident on the tag body can be included.

The preventing mechanism can include a receiving and clutching mechanism, which receives and clutches the tack body, thereby preventing withdrawal of the tack body from the tag body. A release part of the receiving and clutching mechanism when engaged causes the receiving and clutching mechanism to release, thereby allowing withdrawal of the tack body. A second opening in the tag body leads to the arcuate channel which, in turn, leads to the release part of the receiving and clutching mechanism to allow the arcuate probe to engage same to effect the release. A first switch put into a first state by the tack body upon insertion into the tag body. A second switch put into a first state by the tack head upon insertion of the tack body into the tag body. A third switch put into a first state by the arcuate probe when the arcuate probe is introduced into the arcuate channel to engage the receiving and clutching mechanism. The alarm sounds when the first switch is put into a second state without the third switch in its first state, and the alarm also sounds when the second switch is put into a second state without the third switch in its first state.

A lanyard can be used to attach the tag to an article. The alarm can sound when the lanyard is cut or broken or otherwise becomes discontinuous.

In a third aspect of the present invention, an electronic article surveillance tag is provided in which the tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. An LED or other light-emitting device can be made visible on the exterior of the tag body to periodically flash to simulate that the tag contains an armed alarm.

In a fourth aspect of the present invention, an electronic article surveillance tag is provided in which the tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. An alarm is disposed within the tag body, for sounding an audible alarm if the tack assembly is withdrawn from the tag body without the arcuate probe being guided through the arcuate channel to the preventing means. A first switch put into a first state by the tack body upon insertion into the tag body. A second switch put into a first state by the tack head upon insertion of the tack body into the tag body. A third switch put into a first state by the arcuate probe when the arcuate probe is introduced into the arcuate channel to engage the receiving and clutching mechanism. The alarm sounds when the first switch is put into a second state without the third switch in its first state, and the alarm also sounds when the second switch is put into a second state without the third switch in its first state. An LED or other light-emitting device can be made visible on the exterior of the tag body to periodically flash when the alarm is armed. A plurality of relatively small apertures can be disposed on the tag body to permit the audible sound from the alarm to travel from the interior of the tag body to the exterior of the tag body. The plurality of apertures covers a sufficient portion of the tag body to prevent external localization of the position within the tag body of a sound emitting mechanism for generating the sound from the alarm.

A magnet switch for triggering the alarm when a relatively strong magnetic field is incident on the tag body can be included.

A lanyard can be used to attach the tag to an article. The alarm can sound when the lanyard is cut or broken or otherwise becomes discontinuous.

A shield can be provided in said tag body adjacent the sensor to prevent insertion of an instrument through the tag body and into the sensor to damage the sensor.

A shield can be disposed in the tag body adjacent the releasing and clutching mechanism to prevent unauthorized release of the receiving and clutching mechanism by other than the arcuate probe.

In a fifth aspect of the present invention a method for alarming an electronic article surveillance tag having a tag alarm disposed within a tag body, the tag body adapted to receive a tack assembly for releasable attachment of the tag to an article. The method includes providing an electronic article surveillance tag having an internal circuit for sounding an audible alarm in response to unauthorized detachment of the tag. Arming the tag alarm by insertion of a tack assembly into a tag body and sensing a first state of a tack switch, a first state of a plunger switch, and the first state of an on/off switch. Activating the tag alarm upon sensing a second state of the tack switch and the first state of the on/off switch. Activating the tag alarm upon sensing a second state of the plunger switch and the first state of the on/off switch. And, unarming the tag alarm upon sensing the second state of the on/off switch.

Sensing a relatively strong magnetic field incident on the tag body can activate the tag alarm. Sensing a discontinuity in an attached lanyard can activate the tag alarm.

In a sixth aspect of the present invention, an electronic article surveillance system having an electronic article surveillance tag attachable to an article, the electronic article surveillance tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. An alarm, disposed within the tag body, for sounding an audible alarm if the tack assembly is withdrawn from the tag body without the arcuate probe being guided through the arcuate channel to the preventing mechanism. A transmitter for transmitting a first signal into a surveillance zone. A receiver for receiving a tag signal resulting from the interaction in the surveillance zone of the first signal with the detectable electronic article surveillance sensor in the tag body for detecting the presence of the tag in the surveillance zone.

In a seventh aspect of the present invention, an electronic article surveillance system having an electronic article surveillance tag attachable to an article, the electronic article surveillance tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. A shield is provided in said tag body adjacent the sensor to prevent insertion of an instrument through the tag body and into the sensor to damage the sensor. A transmitter for transmitting a first signal into a surveillance zone. A receiver for receiving a tag signal resulting from the interaction in the surveillance zone of the first signal with the detectable electronic article surveillance sensor in the tag body for detecting the presence of the tag in the surveillance zone.

In an eighth aspect of the present invention, an electronic article surveillance system having an electronic article surveillance tag attachable to an article, the electronic article surveillance tag includes a tag body and with a tack assembly for attaching the tag body to an article. The tack assembly includes a tack head and a tack body, which is receivable in the tag body and the tag body is provided with a preventing mechanism for releasably preventing withdrawal of the tack body. Channel defining structure within the tag body defines an arcuate channel. This channel leads to the preventing mechanism and permits an arcuate probe to be guided to such mechanism for releasing same. Release of the preventing mechanism permits withdrawal of tack body thereby separating the tack assembly and article from the tag body. A sensor detectable by an electronic article surveillance system is disposed in said tag body. A shield is disposed in the tag body adjacent the releasing and clutching mechanism to prevent unauthorized release of the receiving and clutching mechanism by other than the arcuate probe. A transmitter for transmitting a first signal into a surveillance zone. A receiver for receiving a tag signal resulting from the interaction in the surveillance zone of the first signal with the detectable electronic article surveillance sensor in the tag body for detecting the presence of the tag in the surveillance zone.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE INVENTION

Figure 1:
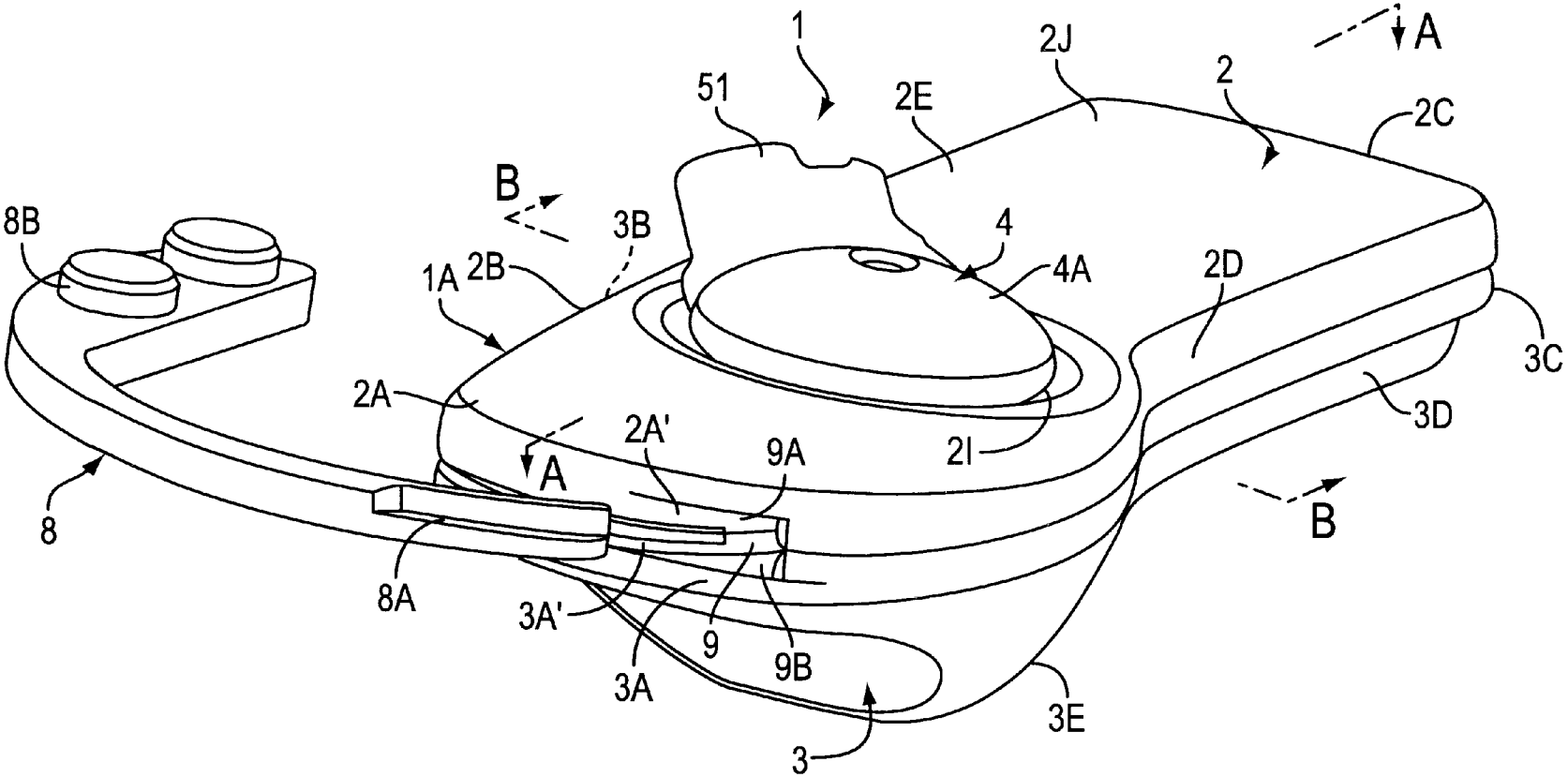
FIG. 1 (PRIOR ART)
FIG. 1. shows a prior art EAS tag and associated detacher probe in accordance with the principles of the present invention.
Figure 2:
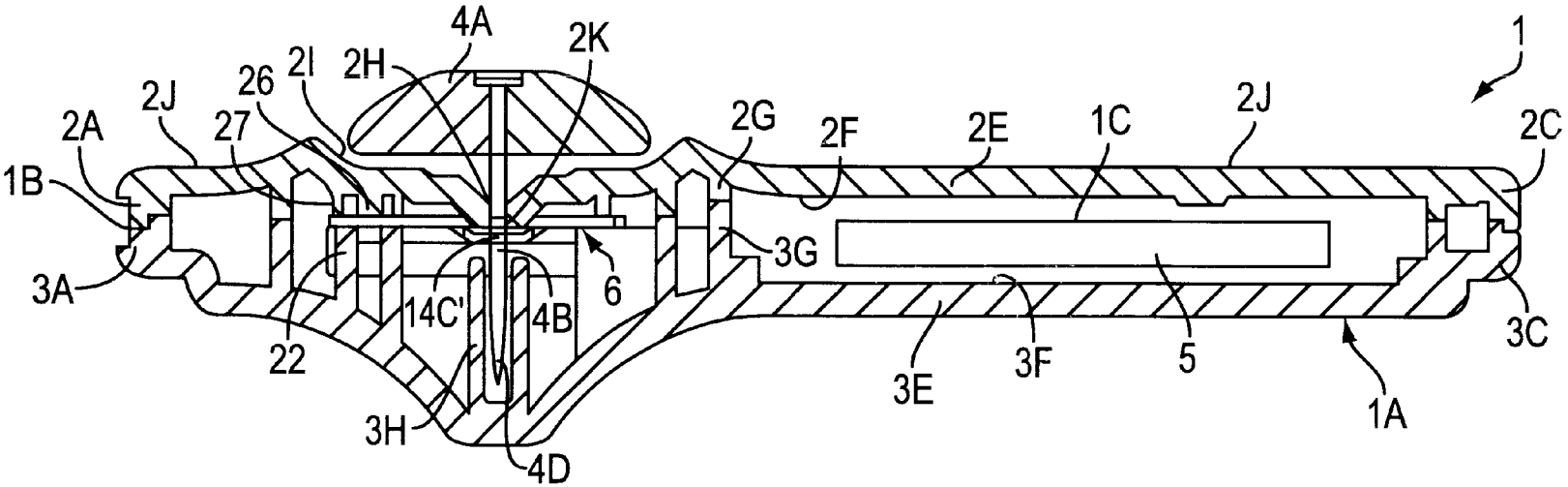
FIG. 2 (PRIOR ART)
FIG. 2 shows a cross-section of the EAS tag of FIG. 1 taken along the line A—A in FIG. 1.
Figure 3:
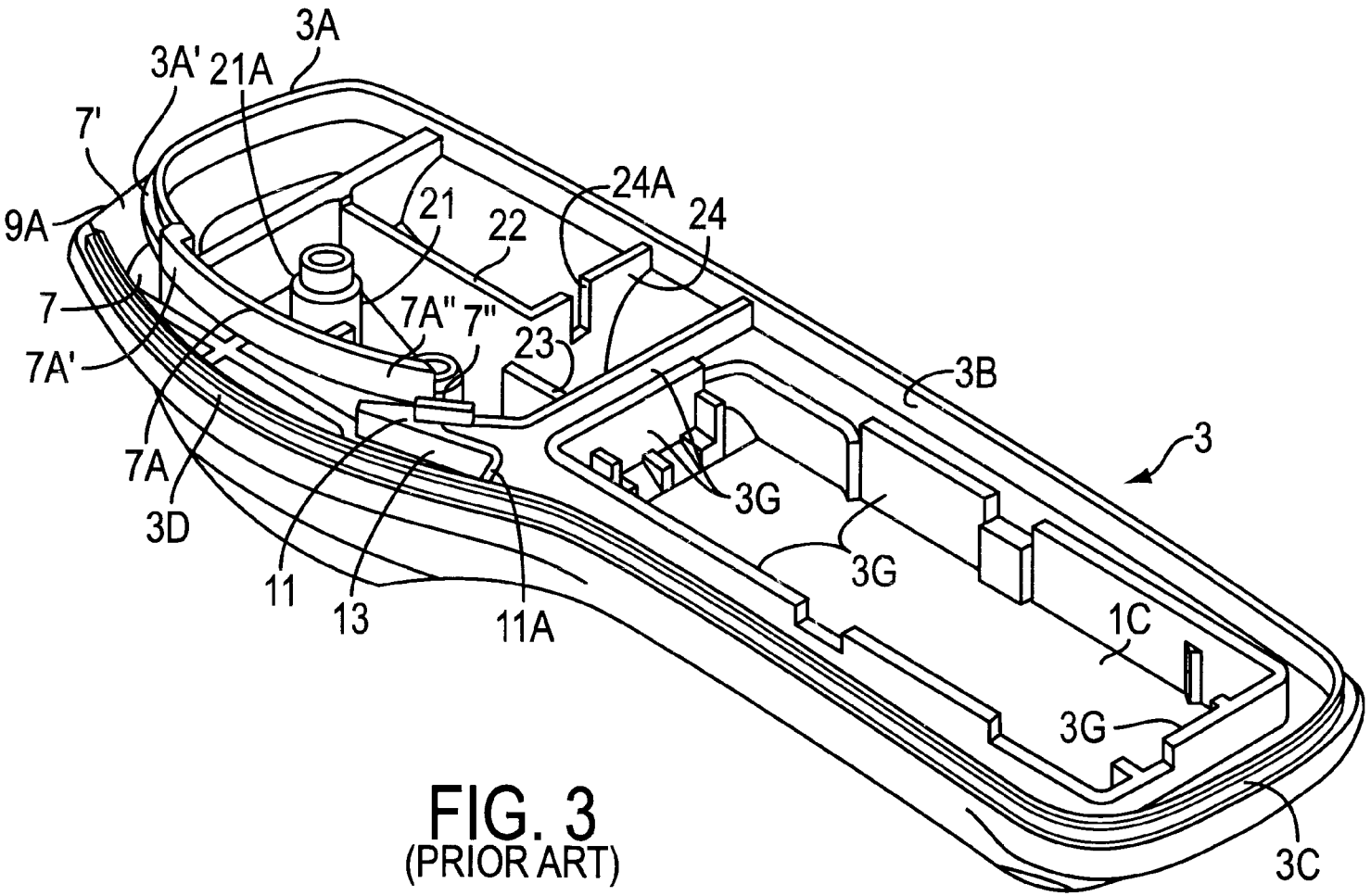
FIG. 3 (PRIOR ART)
FIG. 3 shows a view of the interior of the lower housing of the EAS tag of FIG. 1.
Figures 4A, 4B:
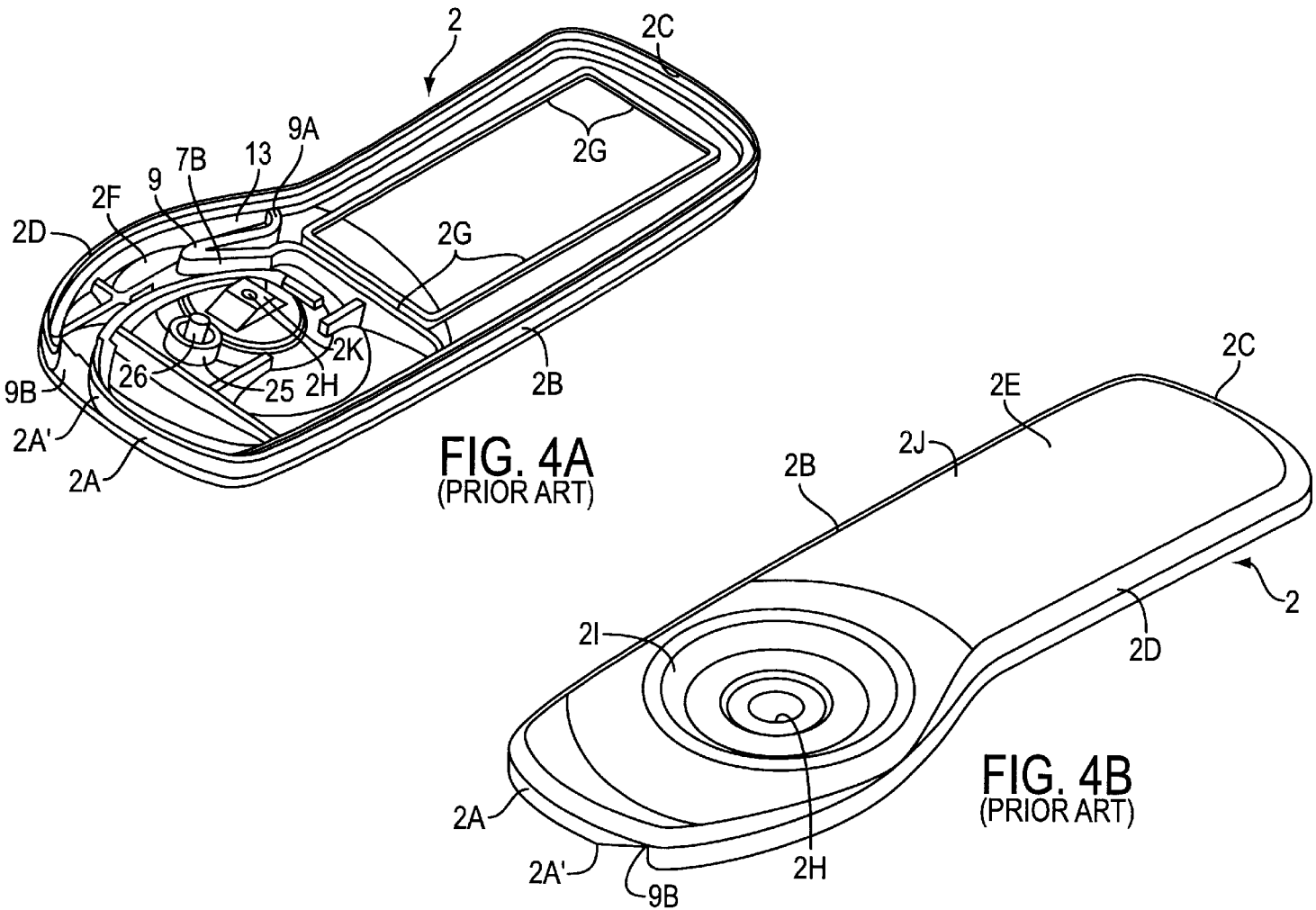
FIG. 4B (PRIOR ART)
FIG. 4A (PRIOR ART)
FIG. 4A shows a view of the interior of the upper housing of the EAS tag of FIG. 1.
FIG. 4B shows a view of the exterior of the upper housing of the EAS tag of FIG. 1.
Figure 5:
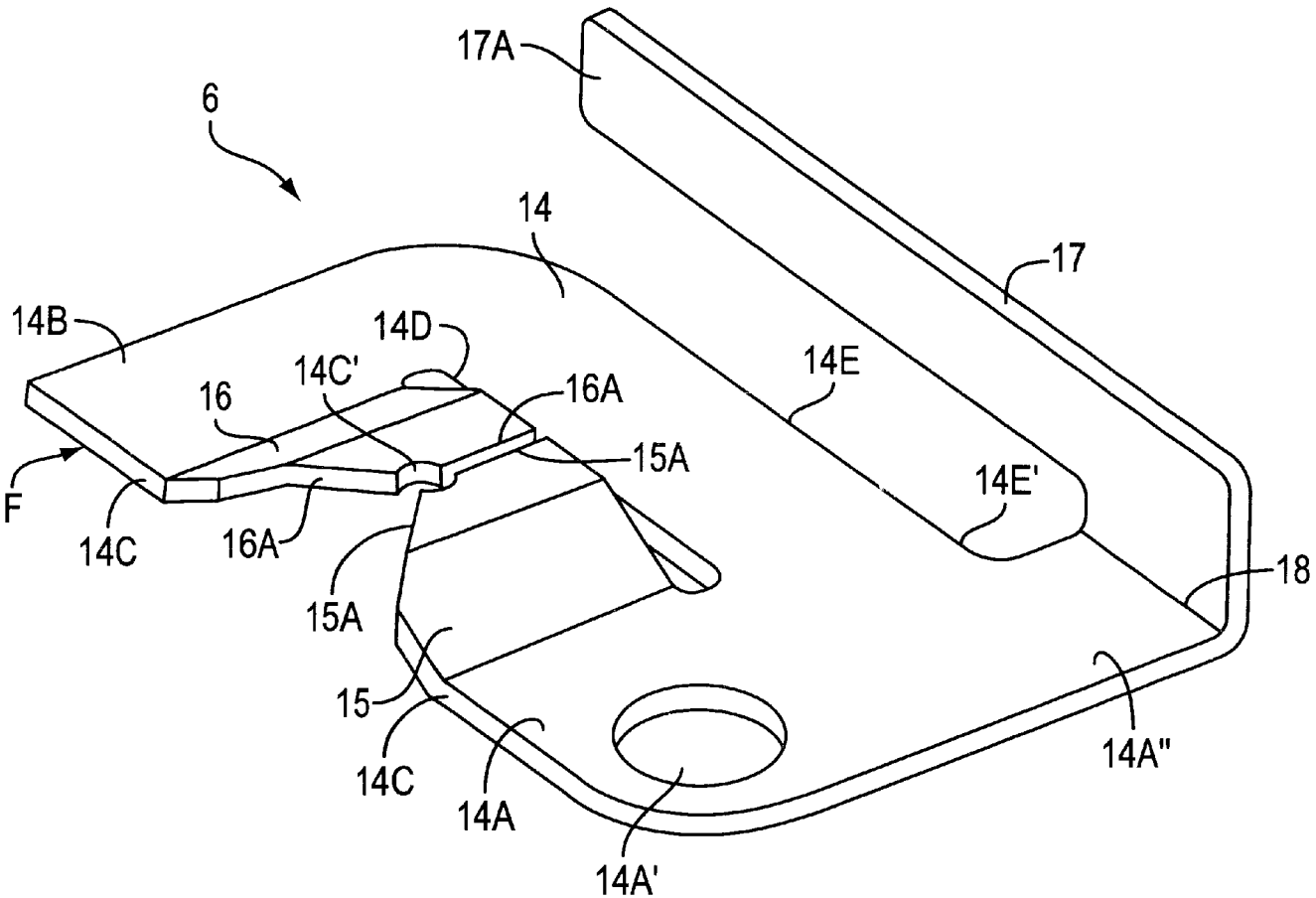
FIG. 5 (PRIOR ART)
FIG. 5 illustrates an exploded view of the spring clamp used in the EAS tag of FIG. 1.
Figure 6A:
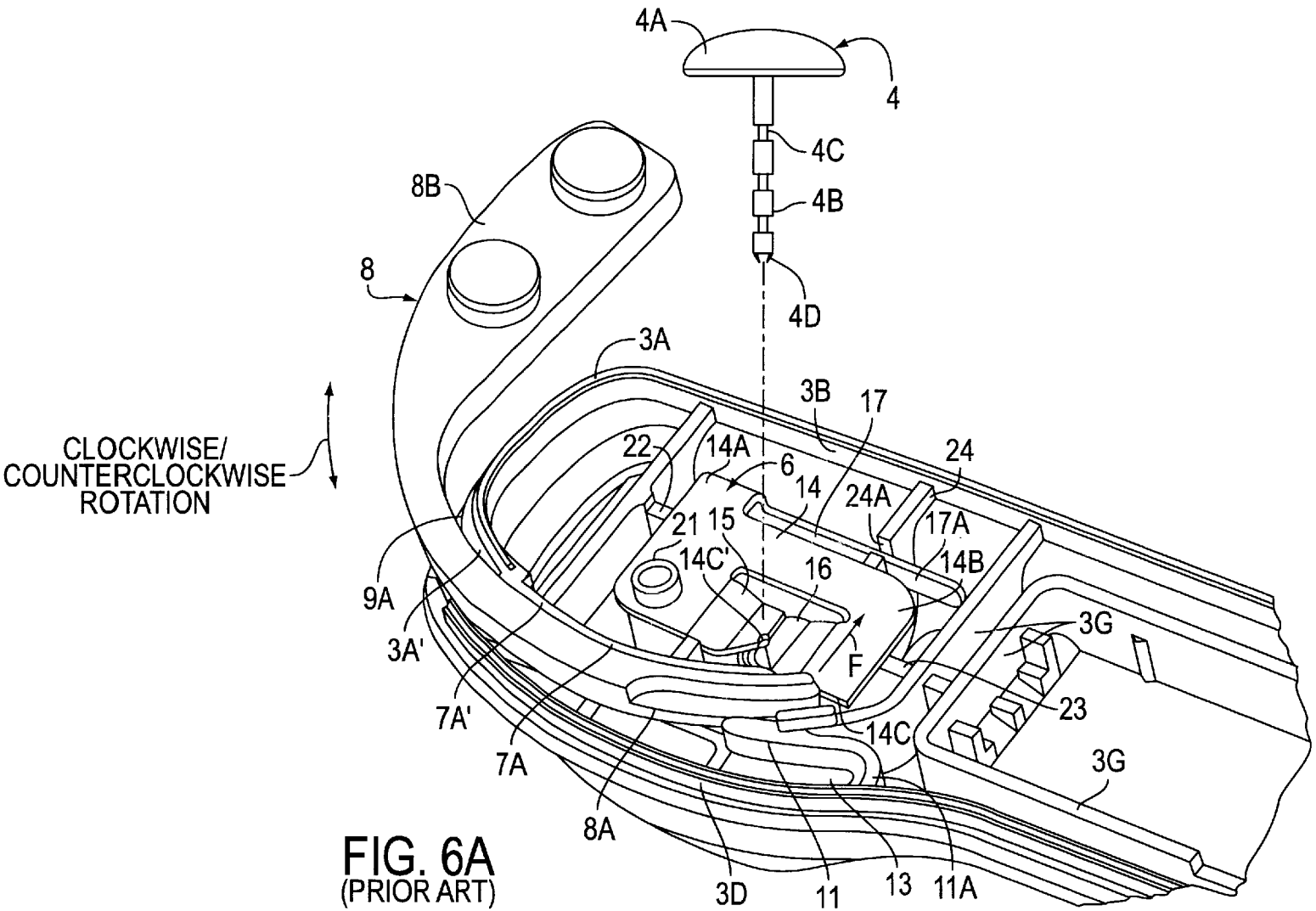
FIG. 6A (PRIOR ART)
FIGS. 6A and 6B show partial views of the interior of the lower housing of the EAS tag of FIG. 1 with the probe inserted in and withdrawn from the arcuate channel of the tag, respectively.
Figure 6B:
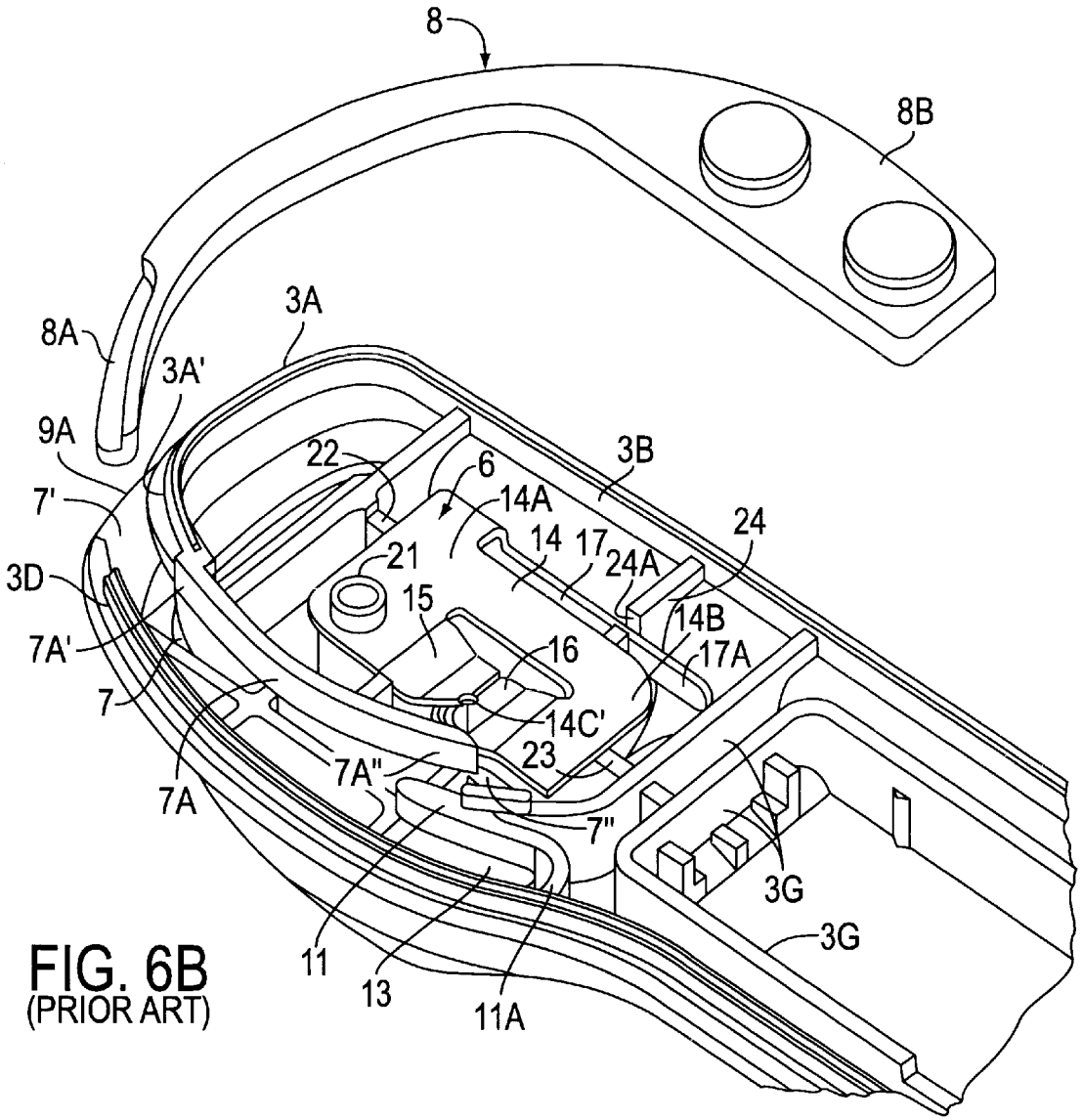
FIG. 6B (PRIOR ART)
Figure 7:
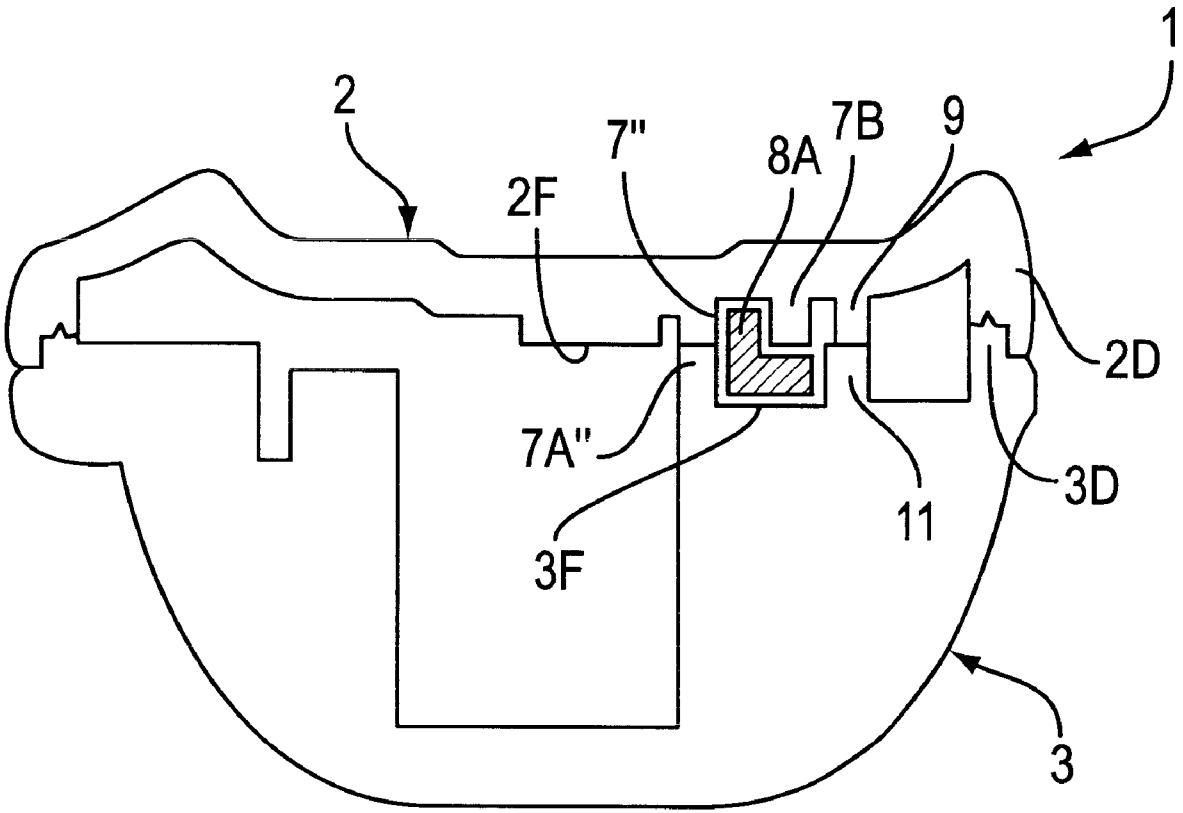
FIG. 7 (PRIOR ART)
FIG. 7 is a cross section of the EAS tag of FIG. 1 taken along the line B—B in FIG. 1 with the probe inserted in the arcuate channel in the tag.
Figure 8:
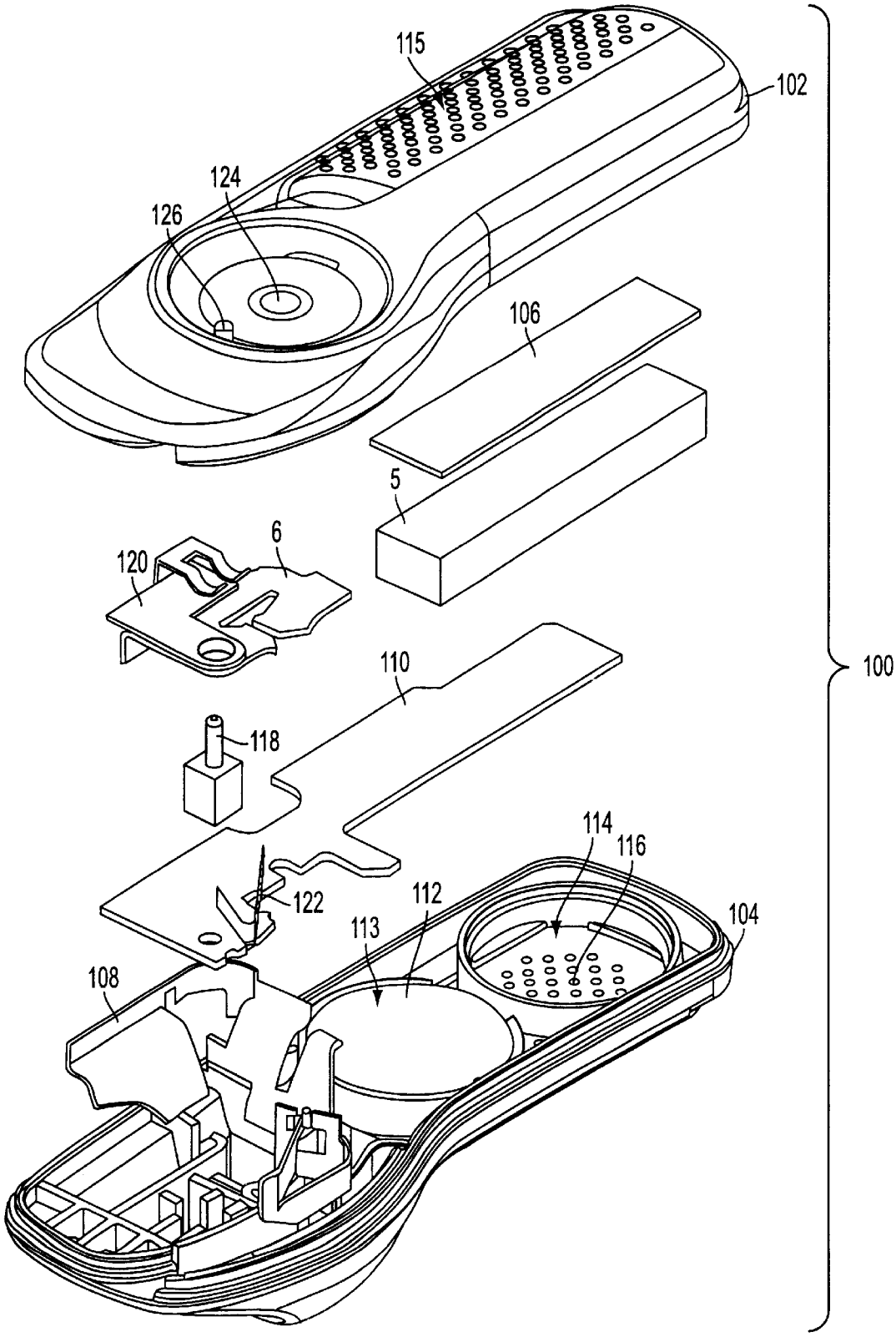
FIG. 8 is an exploded perspective view of an EAS tag incorporating multiple anti-defeat embodiments of the present invention.
Figure 9:
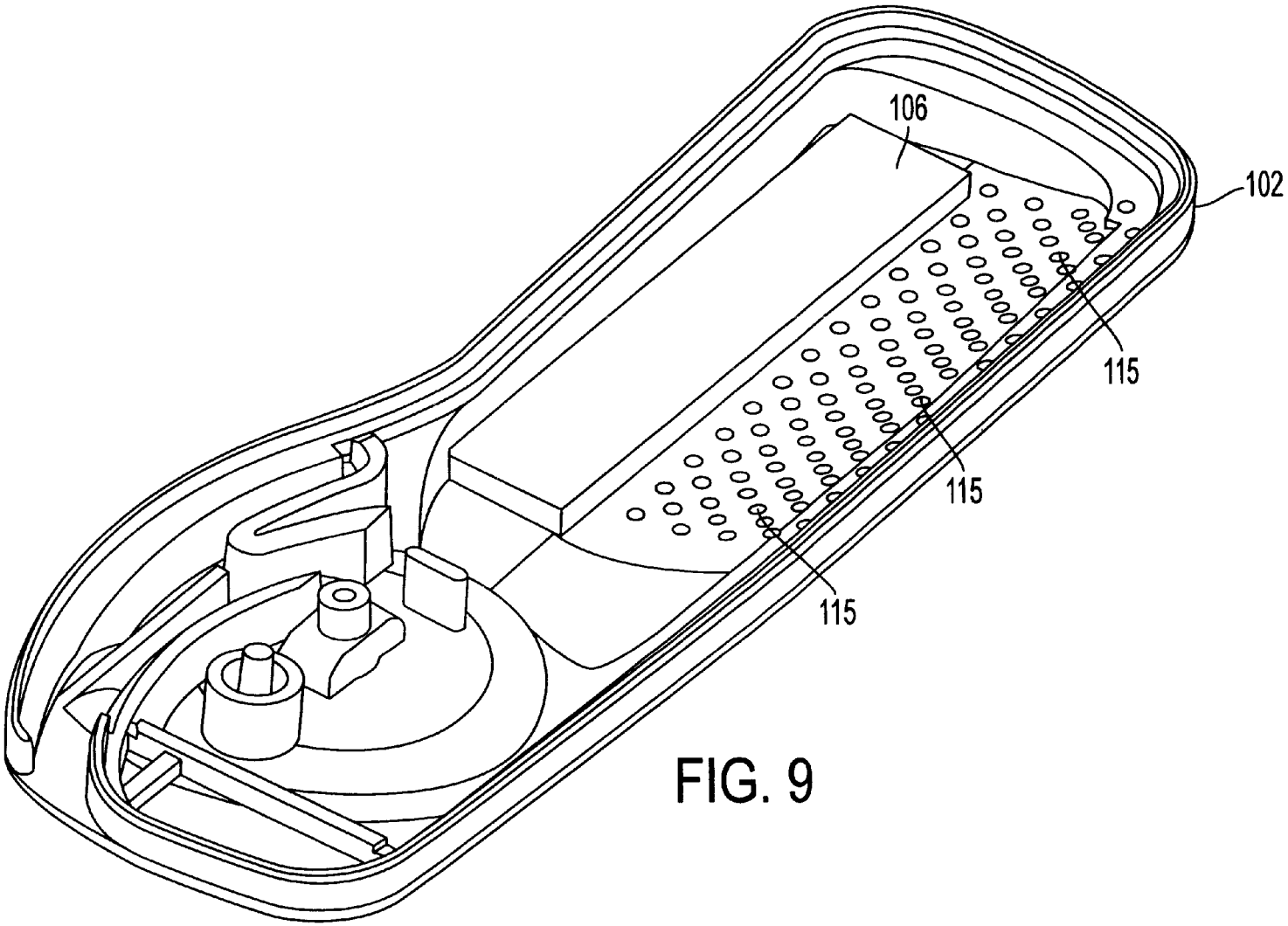
FIG. 9 is an inverted perspective view of the upper tag housing member showing one embodiment of the sensor shield.

Referring to FIG. 8, EAS tag 100 is illustrated incorporating the anti-defeat embodiments of the present invention. Reference numerals below are the same for identical items from prior art FIGS. 1–7. Upper tag housing member 102 and lower tag housing member 104 mate together to capture sensor 5 in a similar manner as EAS tag 1 shown in FIG. 1 and described hereinabove. The terms "upper" and "lower" refer only to the orientation of tag 100 as shown in FIG. 8, and are not structural limitations. Sensor 5 can be any sensor detectable in an EAS system as described herein. Sensor shield 106 is placed on one or both sides of sensor 5 to prevent one mode of defeat where a metal probe, screw driver, or the like, is forced through upper or lower tag housing members 102 or 104, respectively, to damage or destroy sensor 5. Once sensor 5 is destroyed, the article to which tag 100 is attached can be moved through the interrogation zone without setting off an EAS alarm. Sensor shield 106 is preferably made of a nonferrous metal such as stainless steel or other very hard material that does not effect the operation of sensor 5, but which is capable of making the insertion of a metal probe or the like to damage sensor 5 extremely difficult. Referring to FIG. 9, upper tag housing member 102 is shown in an inverted position to illustrate one possible positioning of sensor shield 106.

Figure 10:
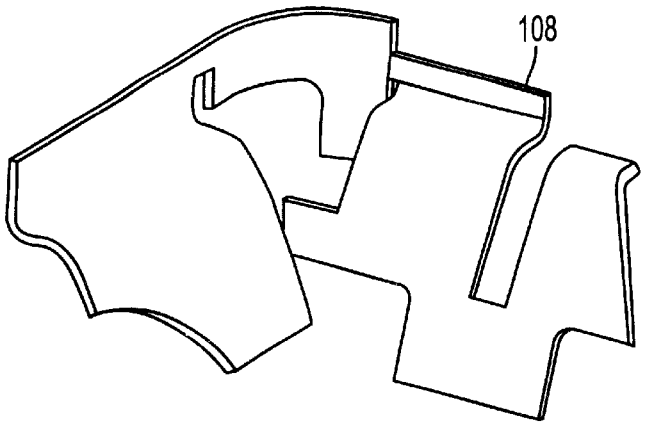
FIG. 10 is a perspective view of one embodiment of the clamp shield.

Returning to FIG. 8, a secondary shield, clamp shield 108, is utilized to prevent another defeat technique. A probe can be forced through upper or lower housing 102 or 104, respectively, to engage spring clamp 6, illustrated in FIGS. 5 and 6A, to rotate spring clamp 6 about support area 14A to release tack body 4B. Thus, a probe forced through upper or lower housing 102 or 104, respectively, can be made to release tack 4 in a similar manner to that described hereinabove in relation to using detaching probe 8. Clamp shield 108 can be made of a metal such as stainless steel or other very hard material that is capable of making the insertion of a metal probe or the like through upper or lower tag housing members 102 or 104, respectively, to act upon spring clamp 6 extremely difficult. FIG. 10 illustrates an embodiment of clamp shield 108 configured to be used with EAS tag 100. The exact shape of clamp shield 108 will depend upon the EAS tag to which it is to be installed.

Figure 11:
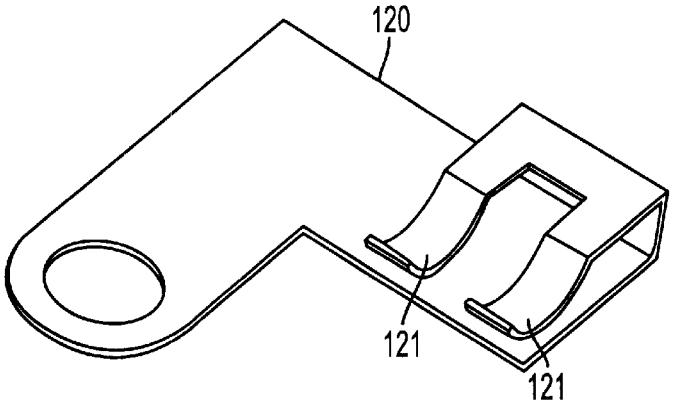
FIG. 11 is a perspective view of one embodiment of the tag on/off switch.
Figure 12:
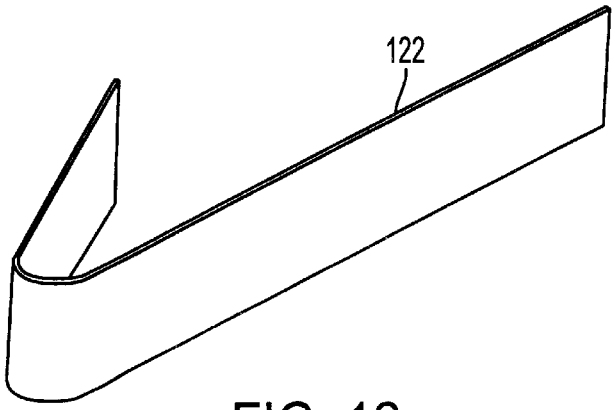
FIG. 12 is a perspective view of one embodiment of the tack switch.

Another preventative measure to prevent tag defeat is a self-alarming tag alarm 150. Tag alarm 150 is fully described hereinbelow and shown in FIG. 14. A self-alarming tag alarm is an alarm signal emitted by the tag itself, and is not the alarm signal emitted by the EAS system when the EAS tag is carried into an interrogation zone. Printed circuit (PC) board 110 contains the circuitry for the alarm, which goes off if the tag 100 is detached by other than detacher probe 8, as fully described hereinbelow. Battery 112 fits into cavity 113, and a piezo transducer 152, shown in FIG. 14, fits into cavity 114, which are both used in conjunction with circuitry on PC board 110 to form the alarm. The alarm can be configured so that battery 112 can be placed into cavity 113 or cavity 114, and the piezo transducer can be placed into the unused cavity. The series of apertures 115 and 116 through the upper and lower tag housing members, respectively, cover the area adjacent both cavities 113 and 114. Because the apertures cover the area adjacent cavities 113 and 114, the apertures 115 and 116 cannot be used as a localized target to direct a probe to the piezo in an attempt to destroy or damage it. A probe forced directly into the piezo could damage or destroy the piezo, but a probe indiscriminately inserted into the tag 100 could set off the tag alarm. The tag alarm will sound upon unauthorized removal of tack 4 from tag 100 according to the position of plunger switch 118, on/off switch 120, and tack or pin switch 122, which are used to provide alarming logic as fully described hereinbelow. On/off switch 120 and tack switch 122 are better seen in FIGS. 11 and 12, respectively.

Figure 13:
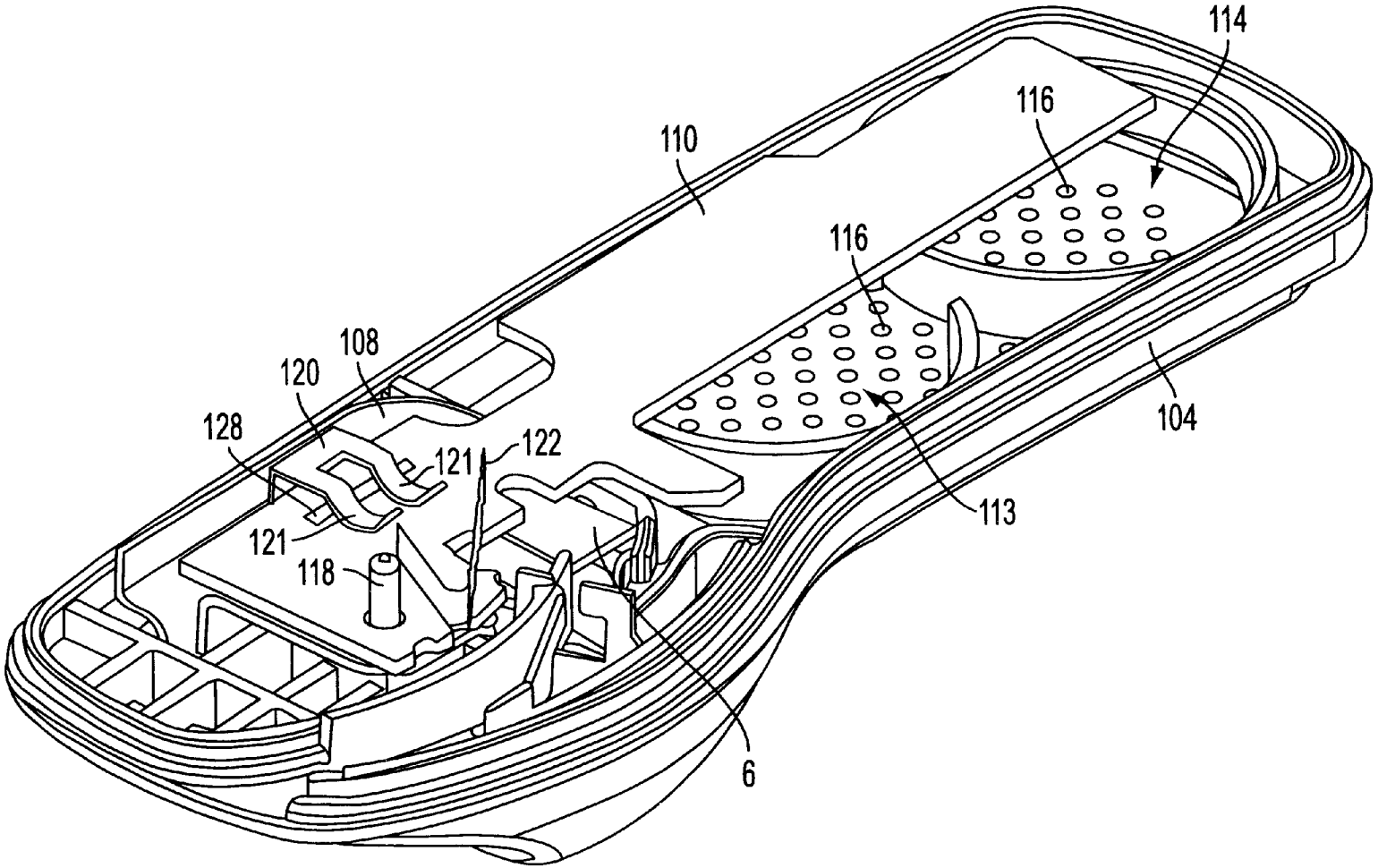
FIG. 13 is a perspective view of the lower tag housing member showing one embodiment of the PC board and switch positions.

Referring to FIGS. 8 and 13, when a tack assembly 4 (shown in FIGS. 1 and 2) is inserted into aperture 124, the bottom of tack head 4A depresses plunger switch 118, which protrudes slightly through aperture 126 in upper tag housing member 102, and tack body 4B simultaneously contacts tack switch 122 moving it into a contact on PC board 110. Both plunger switch 118 and tack switch 122 must be contacted to arm tag 100. Once tag 100 is armed, if either switch 118 or 122 are opened, the tag alarm will sound. If only tack switch 122 was used to arm tag 100, the tack head 4A could be cut or pried off and the tag would not alarm. If only plunger switch 118 is used to arm tag 100, then inadvertent pressing and releasing of plunger switch 118 during normal handling could set off the tag alarm. Once armed, to disarm or turn off the tag alarm of tag 100, on/off switch 120 must make contact with a suitable contact area 128 on PC board 110. On/off switch 120 is adapted to rotate in conjunction with spring clamp 6 during normal detachment of tag 100 using conventional detacher probe 8. Upon rotation, switch contacts 121 engage contact area 128, thus switching the alarm of tag 100 off. The tag alarm switch logic is fully described hereinbelow.

Figure 14:
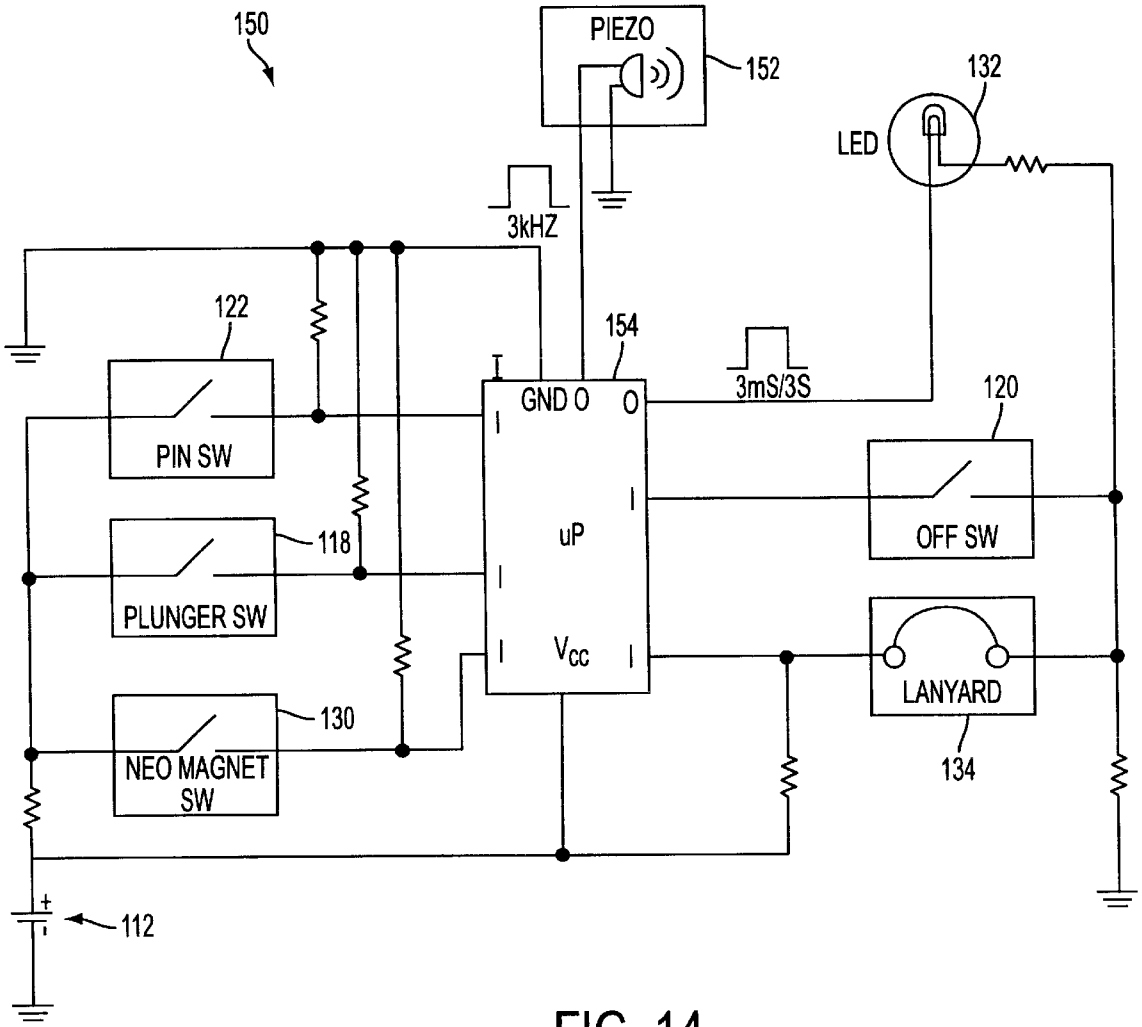
FIG. 14 is a block diagram of one embodiment the tag alarm of the prevent invention.

Referring to FIG. 14, a block diagram of one embodiment of tag alarm 150 is illustrated. Microprocessor 155 is connected to piezo 152, tack or pin switch 122, plunger switch 118, on/off switch 120, and battery 112. Microprocessor 155 generates the signal to drive piezo 152, based upon the switch logic, which is explained fully hereinbelow. Piezo 151 can be driven at about 3 kHz steady, or to conserve battery life, can be pulsed, for example, at 1 Hz, or can be frequency modulated with a deviation of 250 Hz and a modulation frequency of 4 Hz, or driven in a combination of modulation techniques. Piezo 152 can be any small transducer that makes an audible sound and that can be driven at relatively low power.

In addition to the switches described above, magnet switch 130 is connected to microprocessor 154. One embodiment of tag 100 includes a magnetomechanical sensor 5. Magnetomechanical sensors include a magnetostrictive resonator that resonates at a preselected frequency when biased by a magnetic field. Magnetomechanical sensors are thus effected by a magnetic field, and one defeat method involves placing a relatively strong magnet next to the tag so the resonator is no longer biased correctly and no longer resonates at the desired frequency. If the tag does not resonate at the desired frequency, it will not be detected when moved through an interrogation zone. Tag 100 can include a magnet switch 130, which is closed upon exposure to an externally applied magnetic field, thus alarming tag 100. The magnet switch 130 can be any suitable magnet switch such as a reed switch, or a wire segment with a free end positioned within an exposed wire loop, and which moves in an applied magnetic field touching the exposed wire loop to make contact and close the switch.

Figure 15:
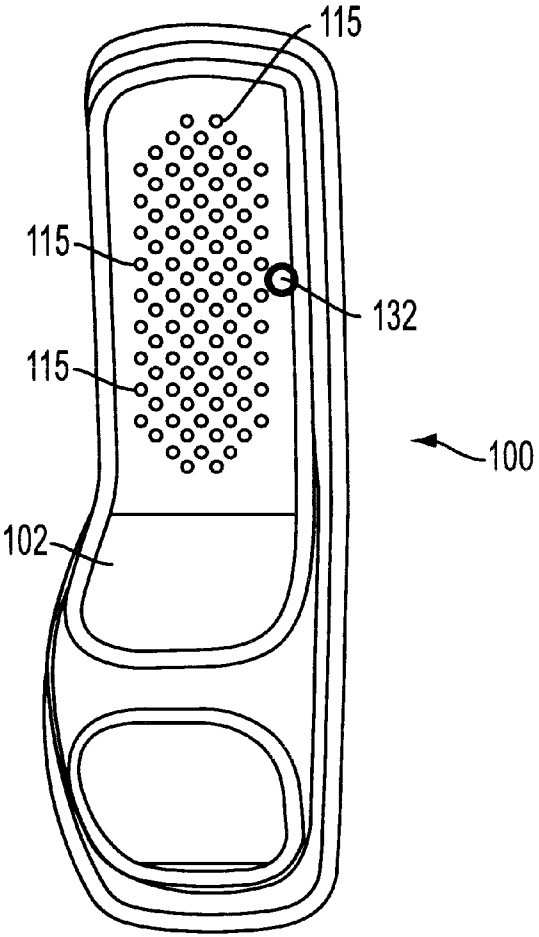
FIG. 15 is a top plan view of one embodiment of the EAS tag of the present invention.

Referring also to FIG. 15, LED 132 is connected to microprocessor 154. When tag 100 is armed, LED 132 flashes to indicate that tag 100 is active. LED 132 can be configured to flash at a desired repetition rate, for example at 3 seconds 'on' and 3 seconds 'off'. To conserve battery life, the 'on' time for LED 132 can be pulsed or cycled at a frequency that is higher than that detectable to the human eye. Thus, during the time that LED 132 is 'on', it will appear to be constant but will actually be cycling 'on' and 'off' very rapidly. For example, the cycle frequency for the 'on' time should be greater than 50 Hz, such as 333 Hz. A flashing LED 132 indicates that tag 100 is armed, and will alarm if tampered with, which provides additional deterrence to defeat attempts. Upon alarming, the repetition rate of 3 seconds 'on' and 3 second 'off' will change, for example, cycling at a faster repetition rate. When the tag 100 is alarming, the response of LED 132 will thus be visually different than when tag 100 is in the armed state. This permits easy location of an alarming tag 100 in proximity to a plurality of armed tags that are not alarming.

Figure 16:
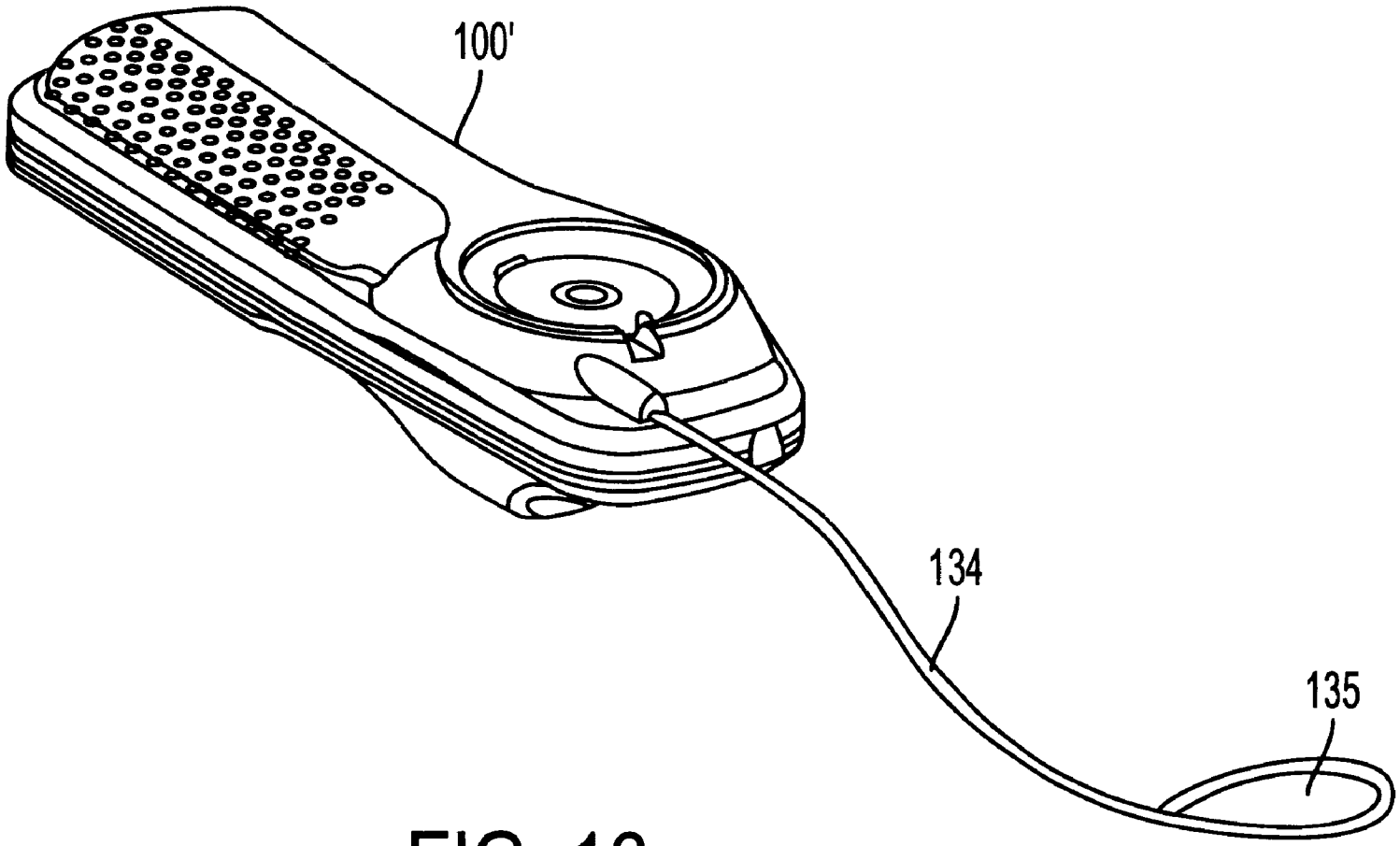
FIG. 16 is a perspective view of another embodiment of the EAS tag of the present invention having a lanyard for attachment of the tag to an article.

Referring also to FIG. 16, lanyard 134 is connected to microprocessor 154, and is used in an embodiment of tag 100', which includes a lanyard 134 for attachment of tag 100' to articles. Lanyard 134 attaches around or through a portion of an article and loop 135 is disposed under tack head 4A, with tack body 4B passing through loop 135 and into tag 100'. Lanyard 134 incorporates an electrical wire and if lanyard 134 is cut, microprocessor 154 will alarm tag 100'.

Figure 17:
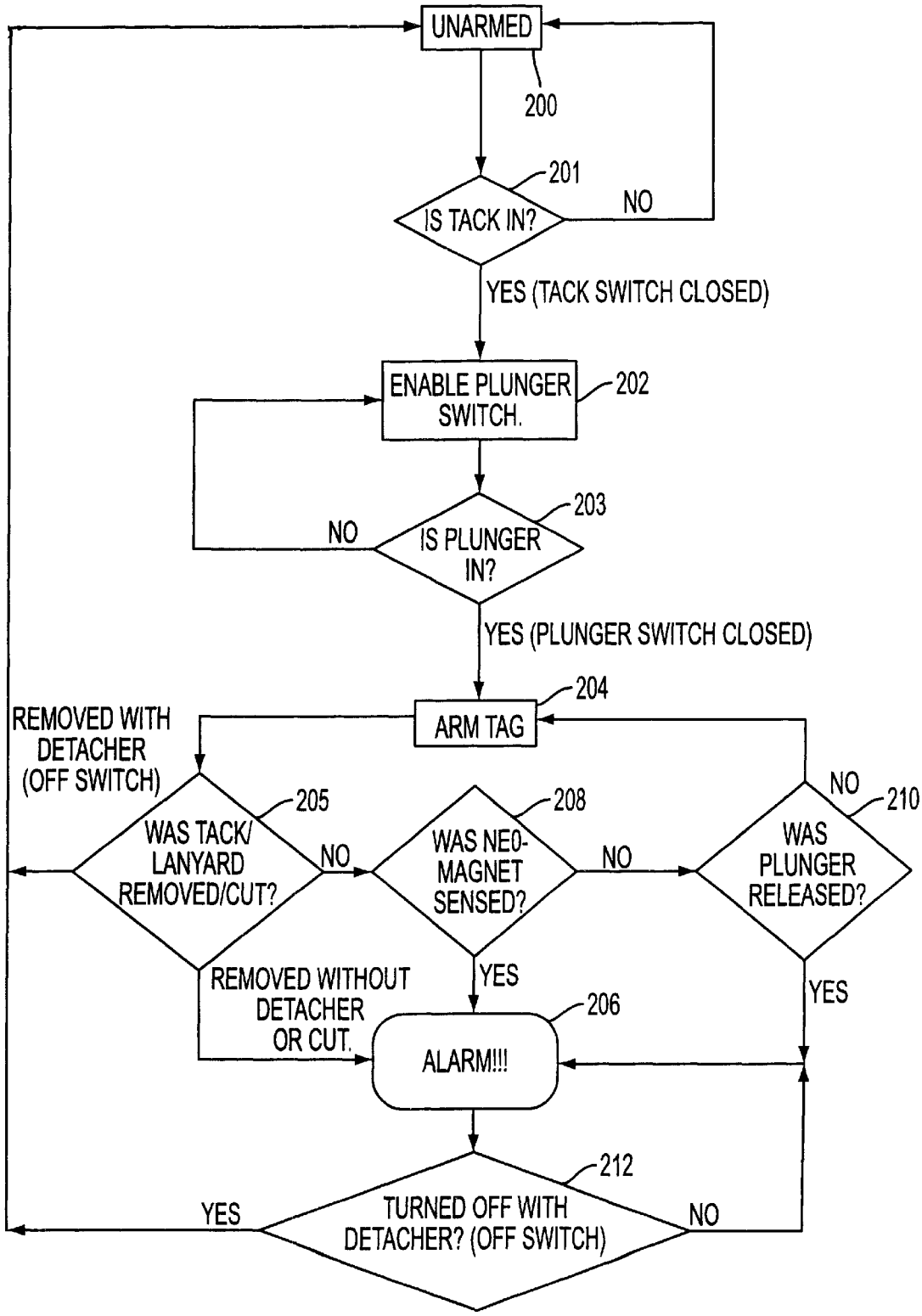
FIG. 17 is a flow chart of the tag alarm switch logic of the present invention

Referring to FIG. 17, the tag alarm switch logic is illustrated, which starts in the unarmed state 200. When the tack 4 is inserted at 201, the tack switch is closed and the plunger switch is enabled at 202. When the plunger switch is closed at 203 the tag is armed at 204. If tack 4 is removed, or if lanyard 134 is cut at 205, without using a detacher probe 8, tag alarm 150 will alarm at 206. If detacher probe 8 was used at 205, the tag is unarmed at 200. If the tack 4 is not removed, or lanyard 134 is not cut, and the magnet switch is closed at 208 by an applied magnetic field, tag alarm 150 will alarm at 206. If the magnet switch is not closed at 208, and the plunger switch is released or opened at 210, the tag will alarm at 206, which indicates that the tack head 4A was cut or pried off. The alarm and the tag is turned off by detachment of tack 4 by detacher probe 8 at 212.

Tag 100 can be configured to have all of the tag defeat devices and methods described hereinabove or any combination thereof. For example, decoy tags could be used where LED 132 flashes to indicate the tag is armed, but the tag may not have an alarm, it may only have the flashing LED. A perpetrator will not know if the tag will alarm or not, as it will appear identical to the tags 100 that are equipped with alarms. Likewise, tag 100 may contain both shields 106 and 108, or neither, or only one of the shields. Alternately, shields 106 and 108 can be incorporated into EAS tag 1 without any self-alarming features.

Figure 18:
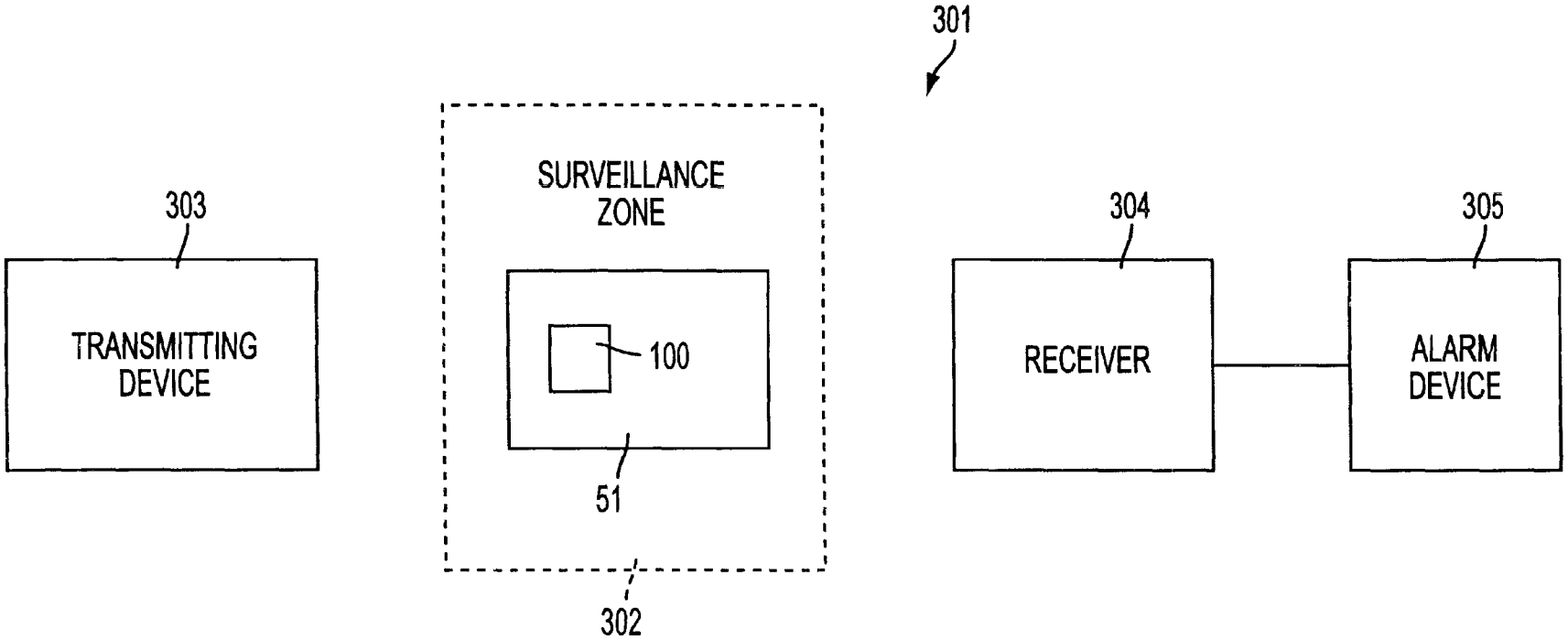
FIG. 18 is a block diagram of an electronic article surveillance system for use in conjunction with the EAS tag of the present invention.

FIG. 18 illustrates an EAS system 301 used to detect or sense EAS tag 100 when passing through a surveillance zone 302. EAS tag 100 is an EAS tag 1, described hereinabove, modified to include the present invention. An interrogation signal is transmitted into the zone 302 via a transmitting device 303. A signal resulting from interaction of the sensor 5 in the tag 100 with the transmitted signal is received at a receiver 304, which communicates with a detection and alarm device 305. The latter detects the received signal and generates an alarm indicating the presence of the tag 100 and the article 51 in the surveillance zone 302.

The particular configurations used for the devices 303, 304 and 305 in the system 301 will depend on the particular nature of the sensor. For example, instead of a transmitter

303 and separate receiver 304, one or more transceivers can be used. For the types of sensors disclosed in the hereinabove-mentioned patents, devices of the types also disclosed in these patents can be used.

It is understood that the above-described arrangements are merely illustrative of the many possible specific embodiments, which represent applications of the present invention. Numerous and varied other arrangements can be readily devised in accordance with the principles, of the present invention without departing from the spirit and scope of the invention.

What is claimed is:

1. An electronic article surveillance tag, comprising:

a tag body having a first opening leading into the interior of said tag body;

preventing means within said tag body for releasably preventing a tack assembly having an elongated tack body and a tack head from being withdrawn from said tag body, said elongated tack body being receivable in said first opening of said tag body and insertable into said tag body;

means within said tag body defining an arcuate channel leading from the exterior of said tag body to said preventing means, said arcuate channel being adapted to receive and guide an arcuate probe to said preventing means for releasing said preventing means from preventing said elongated tack body from being withdrawn from said tag body when therein;

a detectable electronic article surveillance sensor disposed in said tag body; and, shield means disposed in said tag body adjacent said sensor and extending substantially the full length of said sensor for preventing insertion of an instrument through said tag body into said sensor.

2. An electronic article surveillance tag in accordance with claim 1, wherein:

said tag body includes a second opening leading into the interior of said tag body;

said preventing means includes means within the tag body for releasably receiving and clutching the tack body when the tack body is introduced into said tag body through said first opening, said receiving and clutching means upon receiving and clutching said tack body preventing withdrawal of said tack body from said tag body and including a release part which is adapted to be engaged by said arcuate probe to cause said receiving and clutching means to release clutching said tack body to permit said tack body to be withdrawn from said tag body; and, said arcuate channel leads from said second opening in said tag body to said release part of said receiving and clutching means, wherein said arcuate probe when introduced into said arcuate channel is brought into engagement with said release part of said receiving and clutching means to cause said receiving and clutching means to release clutching said tack body to allow withdrawal of said tack body from said tag body.

3. An electronic article surveillance tag in accordance with claim 2, further comprising:

shield means disposed in said tag body adjacent said preventing means to prevent insertion through said tag body of means other than said arcuate probe from engaging said receiving and clutching means to release clutching said tack body.

4. An electronic article surveillance tag, comprising:

a tag body having a first opening leading into the interior of said tag body;

preventing means within said tag body for releasably preventing a tack assembly having an elongated tack body and a tack head from being withdrawn from said tag body, said elongated tack body being receivable in said first opening of said tag body and insertable into said tag body;

means within said tag body defining an arcuate channel leading from the exterior of said tag body to said preventing means, said arcuate channel being adapted to receive and guide an arcuate probe to said preventing means for releasing said preventing means from preventing said elongated tack body from being withdrawn from said tag body when therein;

a detectable electronic article surveillance sensor disposed in said tag body;

alarm means, disposed within said tag body, for sounding an audible alarm if said tack assembly is withdrawn from said tag body without said arcuate probe being guided through said arcuate channel to said preventing means; and, light emitting means for periodically flashing in response to an armed state of said alarm means, the periodic flashing of said light emitting means being visible on an exterior portion of said tag body.

5. An electronic article surveillance tag in accordance with claim 4, wherein said light emitting means flashes at a first repetition rate in response to said armed state of said alarm means and flashes at a second repetition rate in response to an alarming state of said alarm means.

6. An electronic article surveillance tag in accordance with claim 4, further comprising a plurality of relatively small apertures disposed on said tag body to permit audible sound from said alarm means to travel from the interior of said tag body to the exterior of said tag body, said plurality of apertures covering a sufficient portion of said tag body to prevent external localization of the position within said tag body of sound emitting means for generating the sound from said alarm means.

7. An electronic article surveillance tag in accordance with claim 4, further comprising magnet switch means for triggering said alarm means to sound said alarm when a relatively strong magnetic field is incident on said tag body.

8. An electronic article surveillance tag in accordance with claim 4, wherein said tag body includes a second opening leading to the interior of said tag body;

said preventing means includes means within the tag body for releasably receiving and clutching the tack body when the tack body is introduced into said tag body through said first opening, said receiving and clutching means upon receiving and clutching said tack body preventing withdrawal of said tack body from said tag body and including a release part which is adapted to be engaged by said arcuate probe to cause said receiving and clutching means to release clutching said tack body to permit said tack body to be withdrawn from said tag body; and, said arcuate channel leads from said second opening in said tag body to said release part of said receiving and clutching means, wherein said arcuate probe when introduced into said arcuate channel is brought into engagement with said release part of said receiving and clutching means to cause said receiving and clutching means to release clutching said tack body to allow withdrawal of said tack body from said tag body;

a first switch put into a first state by said tack body upon insertion into said tag body, a second switch put into a first state by said tack head upon insertion of said tack body into said tag body, a third switch put into a first state by said arcuate probe when said arcuate probe is introduced into said arcuate channel to engage said receiving and clutching means, said alarm means sounding said alarm when said first switch is put into a second state without said third switch in said first state, and said alarm means sounding said alarm when said second switch is put into a second state without said third switch in said first state.

9. An electronic article surveillance tag in accordance with claim 4, further comprising a lanyard, said lanyard having a first end secured to said tag body and a second end securable by said tack assembly, said alarm means sounding said alarm if said lanyard becomes discontinuous.

10. An electronic article surveillance tag, comprising:

a tag body having a first opening leading into the interior of said tag body;

preventing means within said tag body for releasably preventing a tack assembly having an elongated tack body and a tack head from being withdrawn from said tag body, said elongated tack body being receivable in said first opening of said tag body and insertable into said tag body;

means within said tag body defining an arcuate channel leading from the exterior of said tag body to said preventing means, said arcuate channel being adapted to receive and guide an arcuate probe to said preventing means for releasing said preventing means from preventing said elongated tack body from being withdrawn from said tag body when therein;

a detectable electronic article surveillance sensor disposed in said tag body; and, light emitting means for periodically flashing, said light emitting means being visible on an exterior portion of said tag body to simulate the presence of an alarm means within said tag body.

11. An electronic article surveillance tag, comprising:

a tag body having a first and a second opening leading into the interior of said tag body;

preventing means within said tag body for releasably preventing a tack assembly having an elongated tack body and a tack head from being withdrawn from said tag body, said elongated tack body being receivable in said first opening of said tag body and insertable into said tag body, said preventing means including means within said tag body for releasably receiving and clutching the tack body when the tack body is introduced into said tag body through said first opening, said receiving and clutching means upon receiving and clutching said tack body preventing withdrawal of said tack body from said tag body;

means within said tag body defining an arcuate channel leading from the exterior of said tag body to said preventing means, said arcuate channel being adapted to receive and guide an arcuate probe to said preventing means for releasing said preventing means from preventing said elongated tack body from being withdrawn from said tag body when therein, said preventing means including a release part which is adapted to be engaged by said arcuate probe to cause said receiving and clutching means to release clutching said tack body to permit said tack body to be withdrawn from said tag body, said arcuate channel leads from said second opening in said tag body to said release part of said receiving and clutching means, wherein said arcuate probe when introduced into said arcuate channel is brought into engagement with said release part of said receiving and clutching means to cause said receiving and clutching means to release clutching said tack body to allow withdrawal of said tack body from said tag body;

a detectable electronic article surveillance sensor disposed in said tag body;

alarm means, disposed within said tag body, for sounding an alarm if said tack assembly is withdrawn from said tag body without said arcuate probe being guided through said arcuate channel to said preventing means;

a first switch put into a first state by said tack body upon insertion into said tag body, a second switch put into a first state by said tack head upon insertion of said tack body into said tag body, a third switch put into a first state by said arcuate probe when said arcuate probe is introduced into said arcuate channel to engage said receiving and clutching means, said alarm means sounding said alarm when said first switch is put into a second state without said third switch in said first state, and said alarm means sounding said alarm when said second switch is put into a second state without said third switch in said first state;

light emitting means for flashing in response to an armed state of said alarm means, the flashing of said light emitting means being visible on an exterior portion of said tag body, said armed state defined by said first switch in said first state, said second switch in said first state, and said third switch in a second state; and, a plurality of relatively small apertures disposed on said tag body to permit sound from said alarm means to travel from the interior of said tag body to the exterior of said tag body, said plurality of apertures covering a sufficient portion of said tag body to prevent external localization of the position within said tag body of sound emitting means for generating the sound from said alarm means.

12. An electronic article surveillance tag in accordance with claim 11, further comprising magnet switch means for triggering said alarm means to sound said alarm when a relatively strong magnetic field is incident on said tag body.

13. An electronic article surveillance tag in accordance with claim 11, further comprising a lanyard, said lanyard having a first end secured to said tag body and a second end securable by said tack assembly, said alarm means sounding said alarm if said lanyard is cut or broken.

14. An electronic article surveillance tag in accordance with claim 11, further comprising shield means disposed in said tag body adjacent said sensor for preventing insertion of an instrument through said tag body into said sensor.

15. An electronic article surveillance tag in accordance with claim 11 further comprising shield means disposed in said tag body adjacent said preventing means to prevent insertion through said tag body of means other than said arcuate probe from engaging said receiving and clutching means to release clutching said tack body.

16. An electronic article surveillance tag in accordance with claim 11, wherein said light emitting means flashes at a first repetition rate in response to said armed state of said alarm means and flashes at a second repetition rate when said alarm means sounds said alarm.

17. A method for alarming an electronic article surveillance tag having a tag alarm disposed within a tag body, the tag body adapted to receive a tack assembly for releasable attachment of the tag to an article, comprising:

providing an electronic article surveillance tag having an internal circuit for sounding an audible alarm in response to unauthorized detachment of said tag;

arming the tag alarm by insertion of a tack assembly into a tag body and sensing a first state of a tack switch, a first state of a plunger switch, and the first state of an on/off switch;

activating the tag alarm upon sensing a second state of said tack switch and the first state of said on/off switch;

activating the tag alarm upon sensing a second state of said plunger switch and the first state of said on/off switch;

unarming the tag alarm upon sensing the second state of said on/off switch.

18. The method of claim 17 further comprising activating the tag alarm upon sensing a relatively strong magnetic field incident on said tag body.

19. The method of claim 17 further comprising activating the tag alarm upon sensing a discontinuity in an attached lanyard.

20. An electronic article surveillance system, comprising:

an electronic article surveillance tag attachable to an article, said electronic article surveillance tag comprising;

a tag body having a first opening leading into the interior of said tag body;

preventing means within said tag body for releasably preventing a tack assembly having an elongated tack body and a tack head from being withdrawn from said tag body, said elongated tack body being receivable in said first opening of said tag body and insertable into said tag body;

means within said tag body defining an arcuate channel leading from the exterior of said tag body to said preventing means, said arcuate channel being adapted to receive and guide an arcuate probe to said preventing means for releasing said preventing means from preventing said elongated tack body from being withdrawn from said tag body when therein;

a detectable electronic article surveillance sensor disposed in said tag body; and, shield means disposed in said tag body adjacent said sensor and extending substantially the full length of said sensor for preventing insertion of an instrument through said tag body into said sensor;

means for transmitting a first signal into a surveillance zone; and eans for receiving a tag signal resulting from the interaction in said surveillance zone of said first signal with said detectable electronic article surveillance sensor in said tag body for detecting the presence of said tag in said surveillance zone.

* * * * *